US007798202B2

(12) United States Patent
Streubel et al.

(10) Patent No.: US 7,798,202 B2
(45) Date of Patent: Sep. 21, 2010

(54) WIDE SIDE OF A FUNNEL MOLD

(75) Inventors: Hans Streubel, Erkrath (DE); Jörn Hoffmeister, Moers (DE); Markus Reifferscheid, Korschenbroich (DE); Gereon Fehlemann, Düsseldorf (DE); Thomas Lamberti, Düsseldorf (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 11/512,723

(22) Filed: Aug. 30, 2006

(65) Prior Publication Data

US 2008/0073483 A1 Mar. 27, 2008

(30) Foreign Application Priority Data

Aug. 27, 2005 (DE) ..... 10 2005 040 634

(51) Int. Cl.
*B22D 11/055* (2006.01)

(52) U.S. Cl. ..... 164/418; 164/443

(58) Field of Classification Search ..... 164/418, 164/443, 459, 485
See application file for complete search history.

(56) References Cited

U.S. PATENT DOCUMENTS

| | | | | |
|---|---|---|---|---|
| 3,595,302 | A * | 7/1971 | Mallener | 164/443 |
| 6,173,756 | B1 * | 1/2001 | Fehlemann | 164/443 |
| 6,289,970 | B1 | 9/2001 | Fehlemann | |
| 6,318,448 | B1 | 11/2001 | Fehlemann | |
| 2002/0129922 | A1 * | 9/2002 | Plociennik et al. | 164/443 |

FOREIGN PATENT DOCUMENTS

| | | | |
|---|---|---|---|
| CA | 2296619 | | 8/2000 |
| DE | 19826522 | | 12/1999 |
| DE | 198 29 606 | | 1/2000 |
| DE | 19903929 | | 8/2000 |
| EP | 0987073 | | 3/2000 |
| JP | 57-31449 | * | 2/1982 |

* cited by examiner

*Primary Examiner*—Kuang Lin
(74) *Attorney, Agent, or Firm*—Lucas & Mercanti, LLP; Klaus P. Stoffel

(57) ABSTRACT

A broadside (100) for the broadside of a funnel mold for the casting of metal. Known broadsides of this kind have at least one groove-shaped cooling channel (110) in the backside (R) of the broadside. Adjacent the cooling channel (110) on the backside of the broadside, recesses (A1, . . . , A5) are provided as well as filler elements (140-1, . . . , -5) for the at least partial sealing of the recesses. In order to constructively simplify the broadside in view of the adjustment of a generally constant flow rate of a cooling medium through the cooling channel, it is proposed to design the recesses (A1, . . . , A5) in such a way, that they cross the cooling channel (110) diagonally to its longitudinal direction. Moreover, the recesses (A1, . . . , A5) are in their expansion in longitudinal direction of the cooling channel confined to a section of the cooling channel, and in this direction they have a rectangular-shaped and/or wedge-shaped cross-section, so that the depth of the cooling channel (110) in the broadside (100) in the area of the crossing recesses (A1, . . . , A5) changes step-like and/or linearly and is filled with corresponding filler elements.

20 Claims, 6 Drawing Sheets

WIDE SIDE OF A FUNNEL MOLD

BACKGROUND OF THE INVENTION

1. Field of the Invention

The invention refers to a broadside of a funnel mold for the casting of metal, in particular steel.

2. Description of the Related Art

Such a broadside is known, for example, from published German application DE 198 29 606 A1. The broadside of a mold disclosed therein has on its water side, subsequently called backside, a plurality of groove-like cooling channels which are tapered towards the upper rim because of the funnel-shaped outer surface or pouring side of the casting plate. Next to the cooling channels on the backside of the broadside are recesses which extend each in longitudinal direction of the cooling channels over the entire height of the broadside and which pertain to one cooling channel each. The recesses are backfilled with appropriately dimensioned filler elements. The filler elements project each slightly into the cooling channels and serve thus to define the size of the cross-section of the cooling channels in the broadside. For attachment, the filler elements are inserted in undercuts assigned to the cooling channels. The shaping of the undercuts and the manufacture of the filler elements with a complex profile cross-section suitable for limiting the cross-section of the cooling channels, is constructively rather time-consuming and therefore expensive.

SUMMARY OF THE INVENTION

The object of the present invention is to constructively simplify a known broadside for a funnel mold with several cooling channels with regard to the adjustment of an overall constant flow rate of a cooling medium through the cooling channels.

The broadside according to the invention is characterized in that the recess is formed in such a way that it crosses the cooling channels diagonally in longitudinal direction; that in its extension in longitudinal direction of the cooling channels the recess is at least reduced to a section of the cooling channels, and that in this longitudinal direction the recess has a rectangular and/or wedge-shaped cross-section, so that the depth of the cooling channels in the broadside in the area of the crossing recess is adjustable according to the cross-section of the recess in longitudinal direction of the cooling channels and filled with appropriate filler elements.

The claimed shape of the recess transverse to the longitudinal direction of the cooling channels facilitates advantageously, in concurrence with a filler element filling the recess, a simple and economical possibility for a local adjustment of the desired flow rate of a cooling medium through the cooling channel in the area of the crossing recess. Because the recess crosses through the cooling channel, the filler element can be simply of elongated shape so that it fills the recess; in particular, it does not need to be angled three-dimensionally so that it does not only fit into the recess, but at the same time it projects slightly into the cooling channel, as is the case in the above cited prior art. The recess depth or the thickness of the filler element filling the recess determined the size of the leftover cross-section of the cooling channel which remains in the pouring plate or the extent to which the cross-section of the cooling channel in the area of the traversing recess is reduced locally.

According to the invention, the cross-section of the recess in longitudinal direction of the cooling channel is rectangular-shaped and the corresponding filler element is block-shaped; thus, the production of the recess as well as the filler element is particularly easy and economical. The result is a local step-shaped reduction of the cross-section of the cooling channels in the funnel area, whereby the desired flow cross-section is adjusted. If the filler element has an inclined plane at the contact surface to the cooling channels and the recess also has a compatible angular surface, it is possible to create a stepless cross-section of the cooling channel.

The construction of the recess and, thus, also the adjustment of the flow rate of the cooling medium symmetrically in direction toward the center of the mold has the advantage that the cast metal is cooled symmetrically toward the center of the mold; in this manner, an irregular casting quality over the pouring width of the cast metal is obviated.

If the cooling channels originally provided in the backside of the broadside narrow greatly toward the upper rim of the mold, for example, because of the funnel-shaped design of the mold, it is advantageous to adjust the desired flow rate of the cooling medium not only in one location but simultaneously in several locations along the cooling channels. This is executed, according to the invention, through several recesses arranged along its height on the backside of the mold plate. With regard to the adjustment of a desired distribution of the flow rate of the cooling medium along the cooling channel it is advantageous, if the individual recesses have different depths or the corresponding filler elements have corresponding complementary thicknesses, according to the desired course of depth of the cooling channels in the mold plate.

The immediately adjacent placement of several recesses to each other results in an over-all recess in the backside of the broadside with terraced-shaped base plate, wherein the depth of the individual steps of the terraced base plate preferably increases with increasing distance from the upper rim of the mold. The formation of the over-all recess, at least in the funnel area, has the advantage, that a single collective filler element can be prepared to cover or backfill the over-all recess. Compared to individual filler elements, the placement or arrangement of a collective filler element on the backside of the broadside is less time-consuming.

On the backside of the broadside, typically a water tank is mounted to provide cooling water for the cooling channels. For the attachment of this water tank the invention provides, that mounting bars are formed during the formation of the cooling channels and the recesses on the backside of the broadside; in this manner, they are constructed in one element with the broadside. The mounting bars are equipped with screw threads.

The filler element can be formed integrally, from several parts or in layers over its entire thickness. It is made either of heat conducting material, preferably of copper or a copper alloy, or, alternatively, it can be made of a non-magnetic material, preferably of plastics material.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
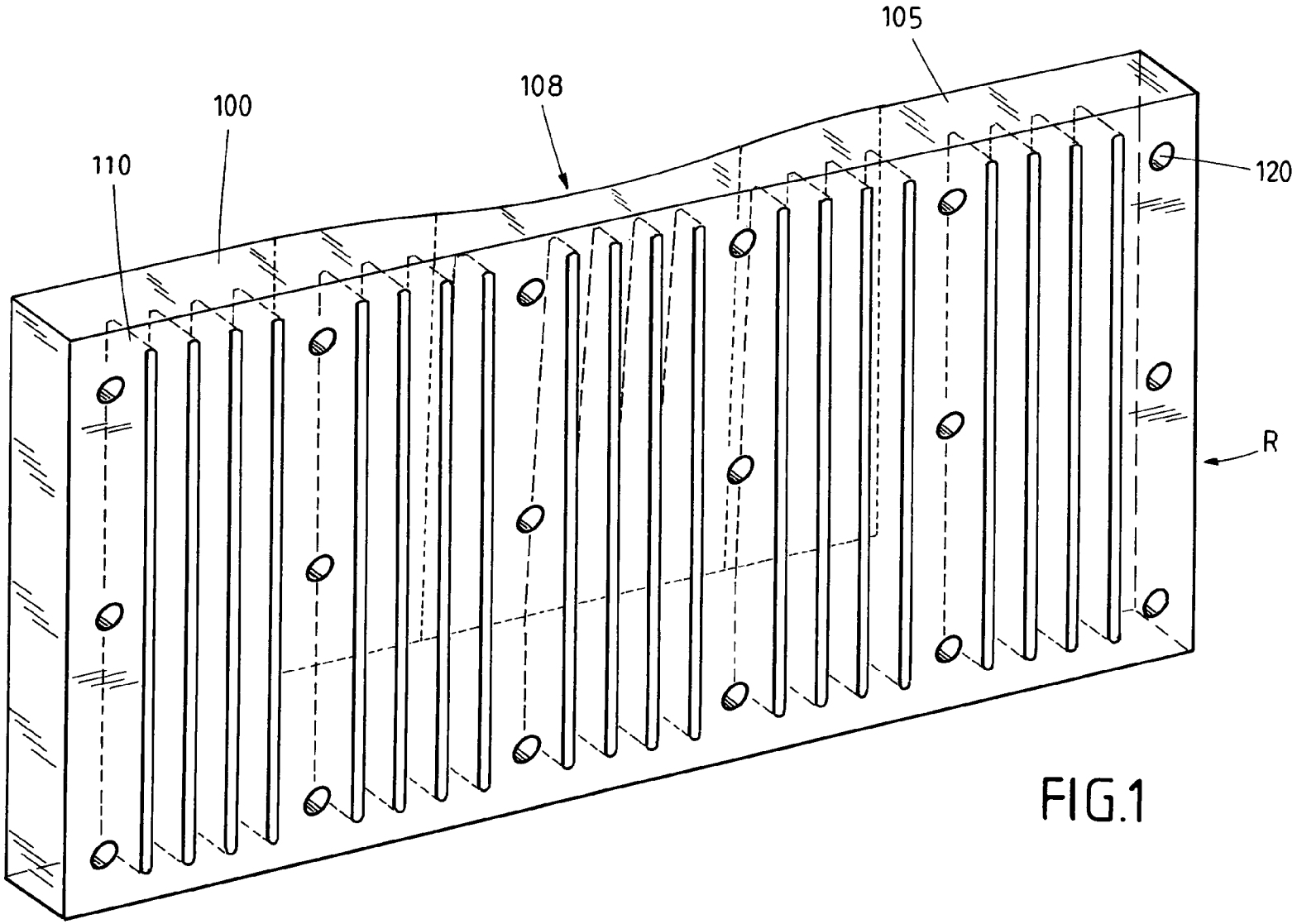
FIG. 1 shows the backside of a broadside with the groove-like cooling channels formed therein.

FIG. 1 shows the backside of a broadside 100 of a funnel mold. The size of the funnel opening 108 of the mold is preferably between 5 and 30 mm. In FIG. 1 can be seen, that from the backside R of the broadside 100 groove-like cooling channels 110 in the form of cooling slots have been millcut into the casting plate. In the area of the funnel opening, the cooling channels are tapered toward the upper rim 105 of the funnel mold, because the thickness of the broadside is also reduced in this area. Furthermore, in FIG. 1 bores 120 are apparent on the backside of the broadside 100 which serve to receive fastening bolts for the attachment of a water tank (not shown) on the backside of the broadside 100. The water tank serves for the allocation of the cooling water to pass through the cooling channels 110 in the broadside 100.

The cooling channels 110 of the present invention are designed relatively narrow compared to generally common cooling channels; typically, their width is between 5 and 15 mm. Simultaneously, their depth is, for example, between 10 and 25 mm. As a result of the mentioned diminution, i.e., a change of depth of the cooling slots over their length as well as over the mold width, the flow rate of the cooling water and, thereby, the evacuation of warmth in individual heights and widths of the broadside would differ. The temperature profile of the broadside on its working or pouring side located opposite its backside is furthermore influenced by the wall thickness of the copper in front of the cooling channels 110 toward the working side.

In order to be able to adjust or influence this temperature profile on the working side in a desired manner, it is suggested, in accordance with the invention, to provide on the backside R of the broadside recesses A1, . . . , A5 at appropriate positions which cross the cooling channels diagonally to its longitudinal direction. During operation of the mold and the broadside 100, the recesses are thus at least partially backfilled with the correspondingly dimensioned filler elements 140-1, . . . , -5 according to the volume defined by the recess, whereby the depth of the cooling channels crossed by the recess in the area of this backfilled recess is configured locally in a steplike manner.

FIGS. 2-5 show a first embodiment for the design of a broadside according to the invention, in particular for recesses on its backside and for the corresponding filler elements.

Figure 2:
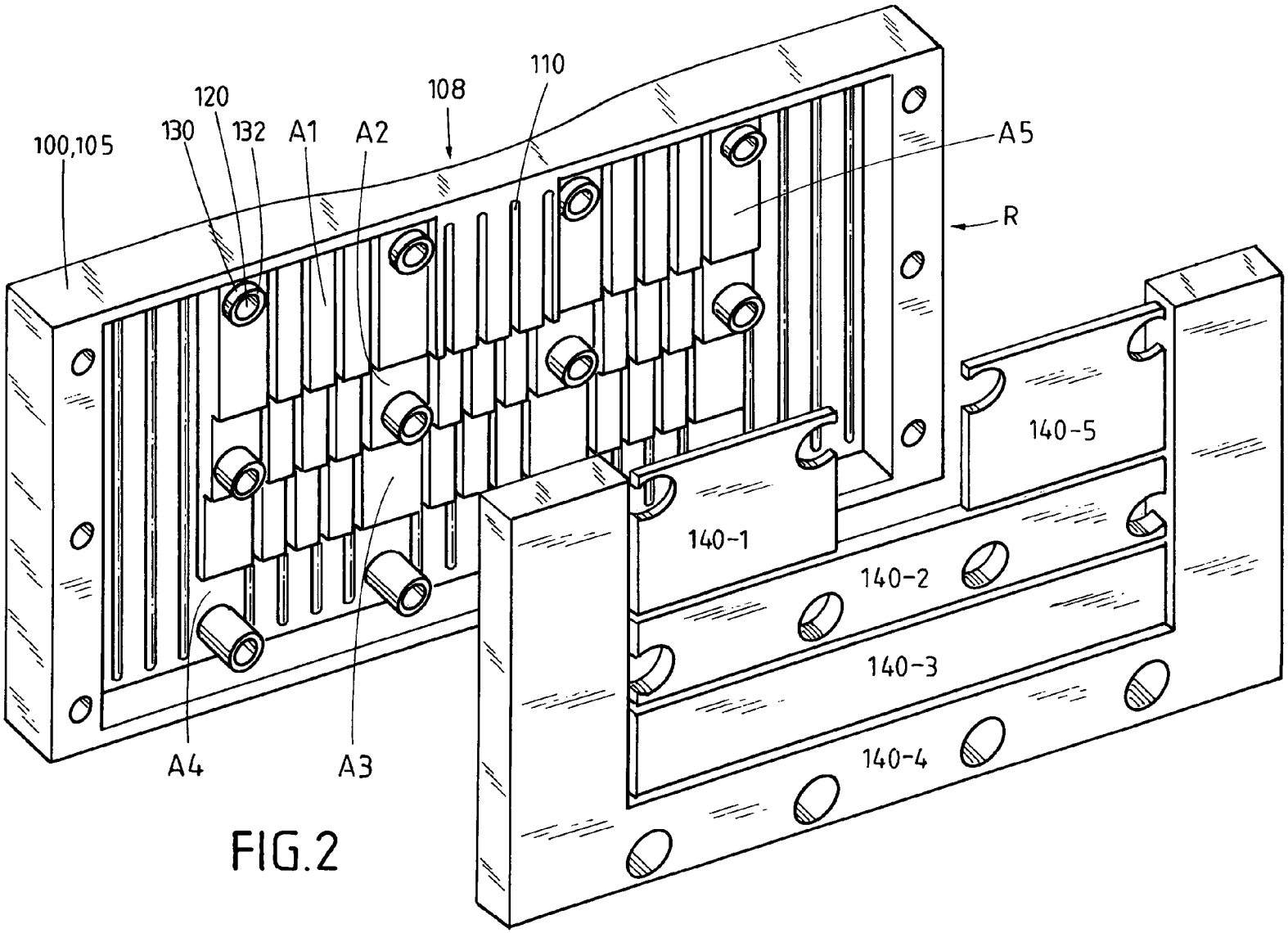
FIG. 2 shows the backside of the broadside with the recesses and filler elements for backfilling the recesses according to the invention.

FIG. 2 shows, on the one hand, a backside R of a broadside according to the first embodiment with several corresponding recesses of variable depths and, on the other hand, corresponding filler elements 140-1, . . . -5 for backfilling the recesses A1, . . . , A5.

In the recesses A1, . . . , A5 according to the first embodiment, it is apparent that they are formed symmetrically toward the center of the mold so that a symmetrical heat distribution can be performed transverse to the longitudinal direction of the cooling channels 110. Altogether, the example here shown has five recesses A1, . . . , A5 of variable depths which are arranged immediately adjacent each other. The five different recesses can be distinguished, on the one hand, in the opened backside R of the broadside of FIG. 2; on the other hand, they are also represented in the five different filler elements 140-1, . . . -5 according to the first embodiment, for backfilling the corresponding recesses, as also shown in FIG. 2.

Since the cooling channels in the area of the funnel opening 108 are tapered toward the upper rim 105 of the mold, as illustrated in FIG. 1, and in order to provide an overall constant flow rate of cooling water through the cooling channels in this area, it is necessary that the recesses A1, . . . A5 in the upper area of the broadside 100, where the cooling channels 110 are not very deep, are designed less deep than in the lower part of the broadside, where the cooling channels have a greater cross-section because of their greater depth. The result is a step-like formation of the backside of the broadside, as distinguishable in FIG. 2; thereby, the difference between the depths of two adjacent recesses is, for example, between 0.5 and 4 mm, yet preferably between 1 and 2 mm. By backfilling the recesses A1, . . . , A5 with the appropriately thick filler elements 140-1, . . . , -5, also shown in FIG. 2, the cross-section of the cooling channels 110 can be integratively or progressively adjusted, at least by approximation, over the entire height of the broadside. As can be seen in FIG. 2, in a top view of the backside R of the broadside 100, the filler elements 140-1, . . . , -5 are essentially of rectangular or U-shaped configuration and have each a continuous thickness corresponding to the depth of the recesses A1, . . . , A5 to be covered by them.

As can be seen in FIG. 2, the bores 120 are preserved during elaboration of the recesses and cooling channels on the backside of the broadside 100 by excluding the proximity of these bores 120 from the recess. Thus, fastening bars 130 with contact surfaces 132 and with bores 120 remain. The contact surfaces of all fastening bars are preferably situated in one plain and thus provide a good possibility to fasten the mold plate on the water tank without mechanical tensions. The bores have on their inner side a screw thread for fastening of a mounting bolt, wherein the depth of the screw thread can be up to 5 mm deeper than the depth of the adjacent cooling slots. In general, the depth of the cooling channels 110 can be locally increased in the area of the screw threads in order to equalize the temperature profile on the working side of the broadside 100.

The individual filler elements 140-1, . . . , -5, as shown in FIG. 2, can be connected to a one-piece overall filler element. The individual filler elements or the overall filler element can be configured in one element or in form of a sandwich, i.e., in layers. Preferably, the filler elements 140-1, . . . , -5 are made of a heat-conductive material in the shape of a filler sheet made of copper or a copper alloy. Alternatively, the filler elements can also be produced from a non-magnetic material, preferably from plastics material.

Figure 3:
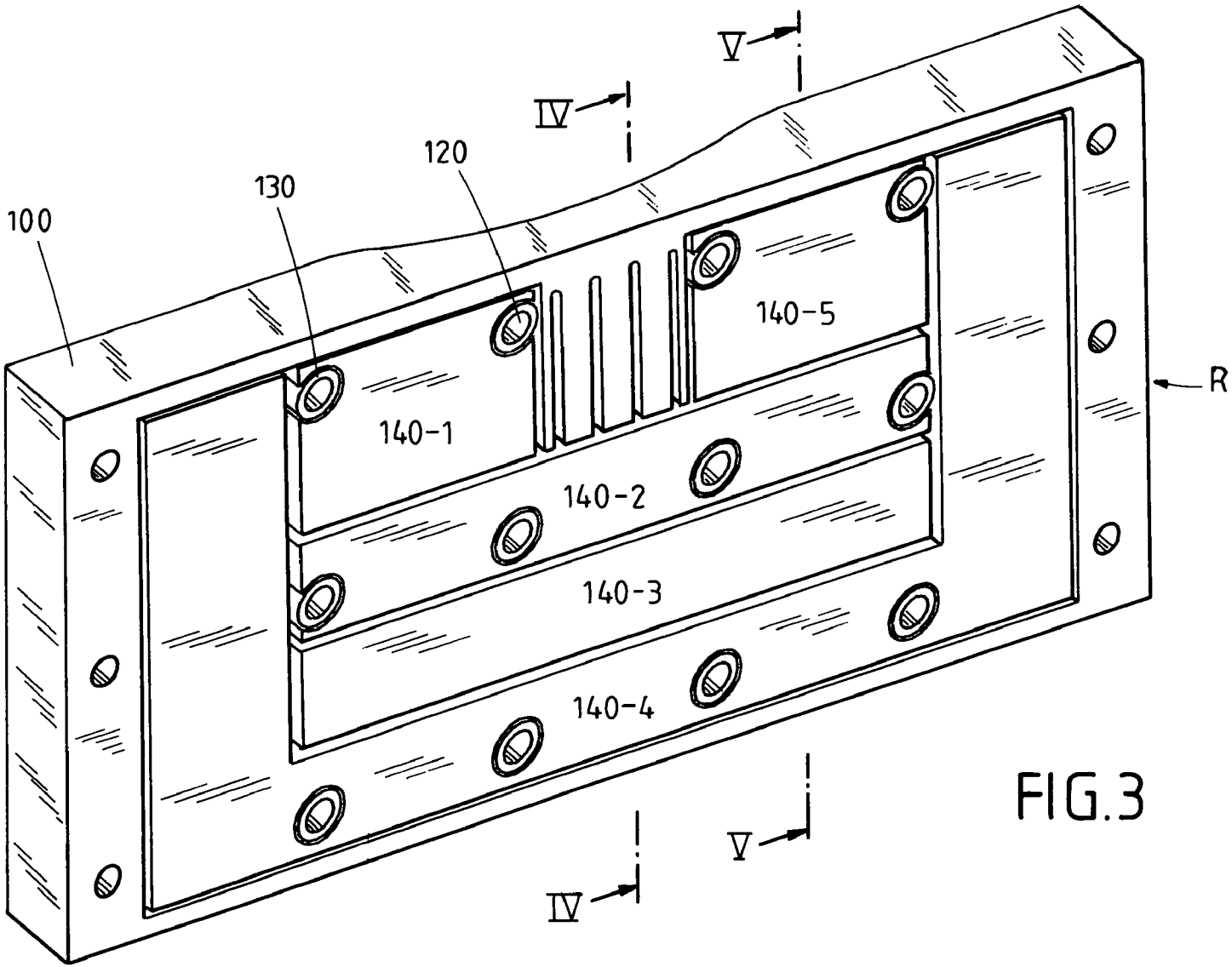
FIG. 3 shows the backside of the broadside with inserted filler elements.

FIG. 3 shows the broadside 100 known from FIG. 2 and the corresponding filler elements 140-1, . . . , -5 in an assembled state. Preferably, the thicknesses of the filler elements 140-1, . . . , -5 are slightly smaller than the depths of the recesses which they are to cover, so that, in an assembled state, the mold plate abuts only in the border area and the fastening bars against the water tank.

Figure 4:
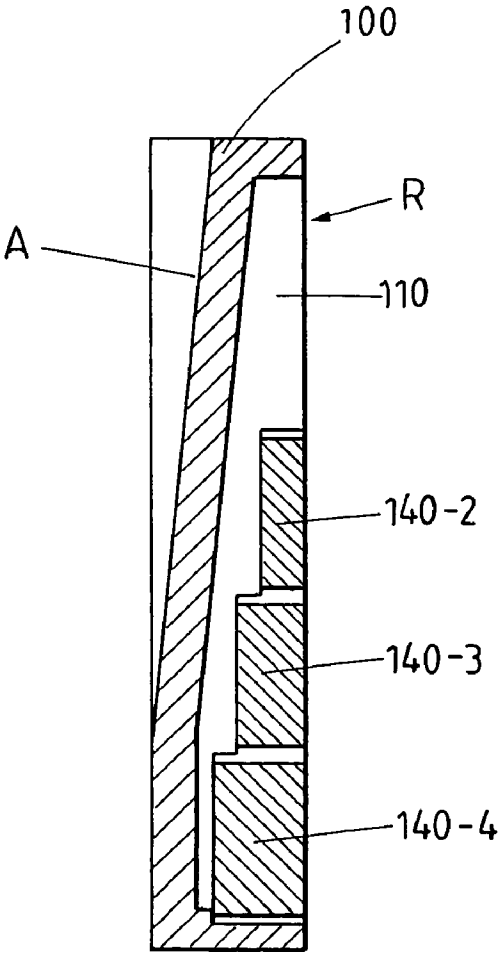
FIG. 4 is a first cross-sectional view through the broadside according to FIG. 3; and along intersectional line IV-IV.

FIG. 4 shows a first cross-section along intersectional line IV-IV through the broadside according to FIG. 3. It is apparent, that in the upper area of the broadside, i.e., in the area of the mold opening, cooling channel 110 was left in its original cross-section; in this area, the depth of the cooling channel 110 is not reduced with a filler element. Furthermore, it can be seen, that the progress of the depth of the cooling channel 110 in the broadside 100 in the area of the crossing recesses is locally adjusted in a step-like manner due to the filler elements 140-2, . . . , -4 positioned in this area. With the recesses and the filler elements it is also possible to set a different cross-section of the cooling channel 110 and, by way of the modified flow rate of the passing water, an accordingly modified heat profile on the pouring side A of the casting plate 100. If the recess is configured with an inclined plane and if there exist complementarily configured filler elements, a stepless adjustment of the cooling channel cross-section can be obtained.

Figure 5:
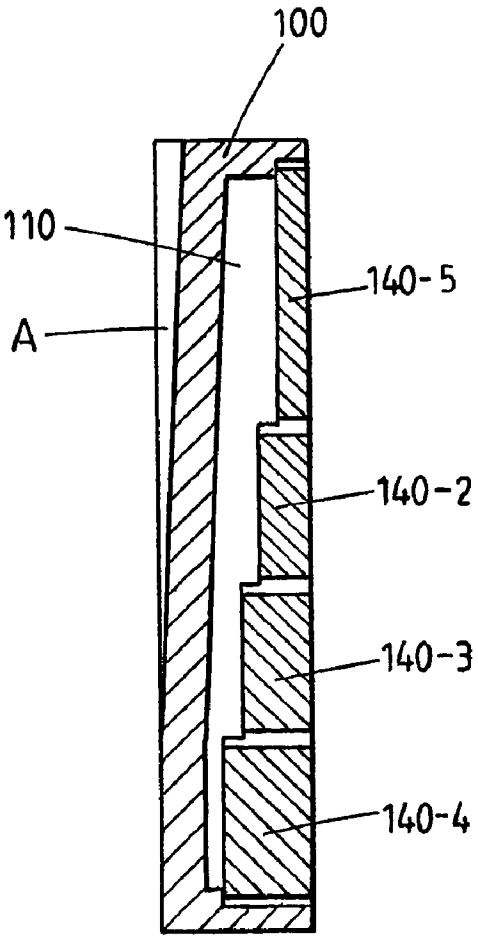
FIG. 5 is a second cross-sectional view through the broadside according to FIG. 3 along intersectional line V-V.

FIG. 5 shows a second cross-section along intersectional line V-V through the assembled broadside 100 as shown in FIG. 3. The statements made for FIG. 4 are equally valid for FIG. 5, with the only difference that the cross-section of the cooling channel 110 was also adjusted in the upper area of the broadside 100 with a filler element 140-5, and thus the flow rate of the cooling water was adjusted also in this area.

Figure 6:
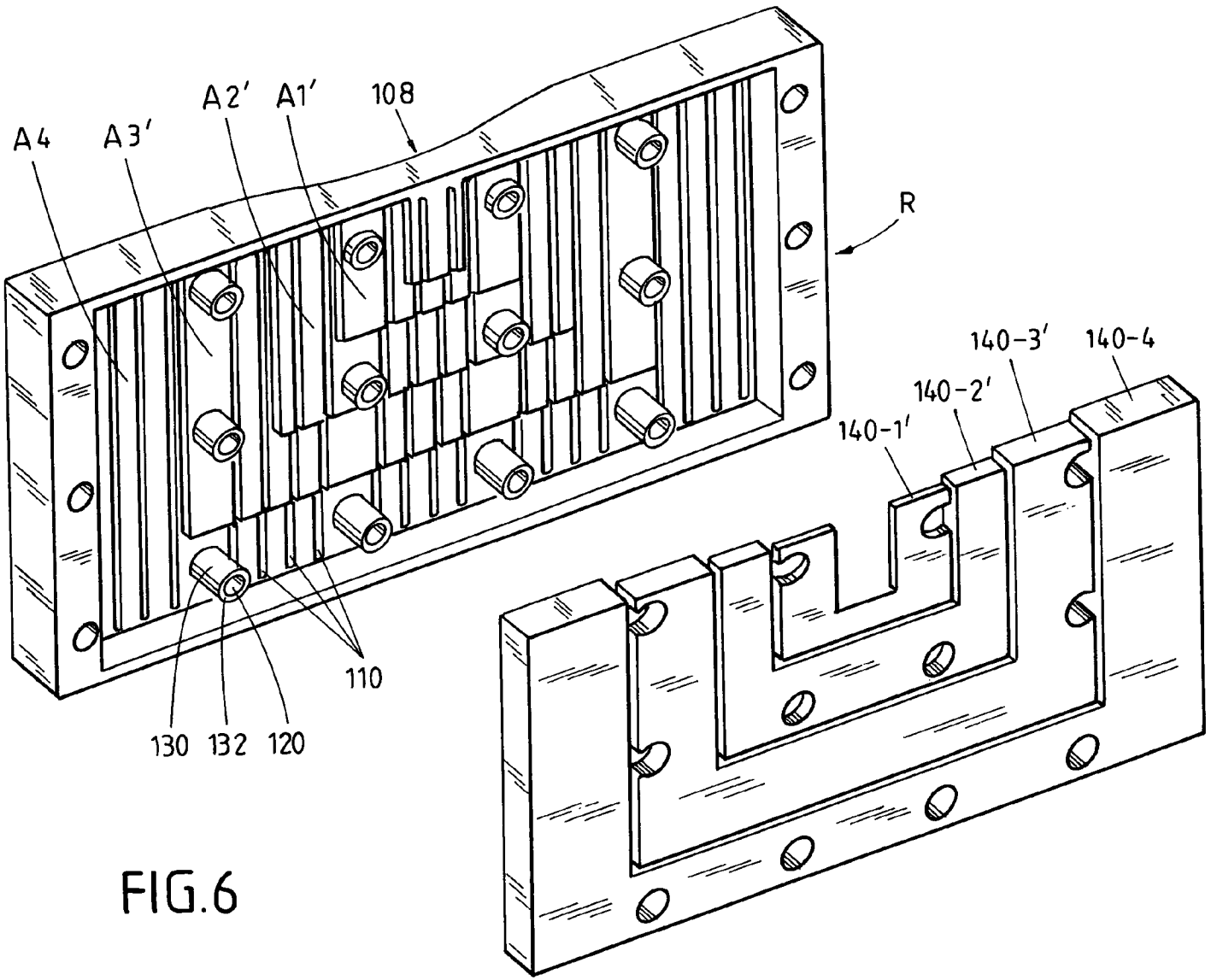
FIG. 6 shows the backside of the broadside with recesses and filler elements for backfilling these recesses formed according to a second embodiment.
Figure 7:
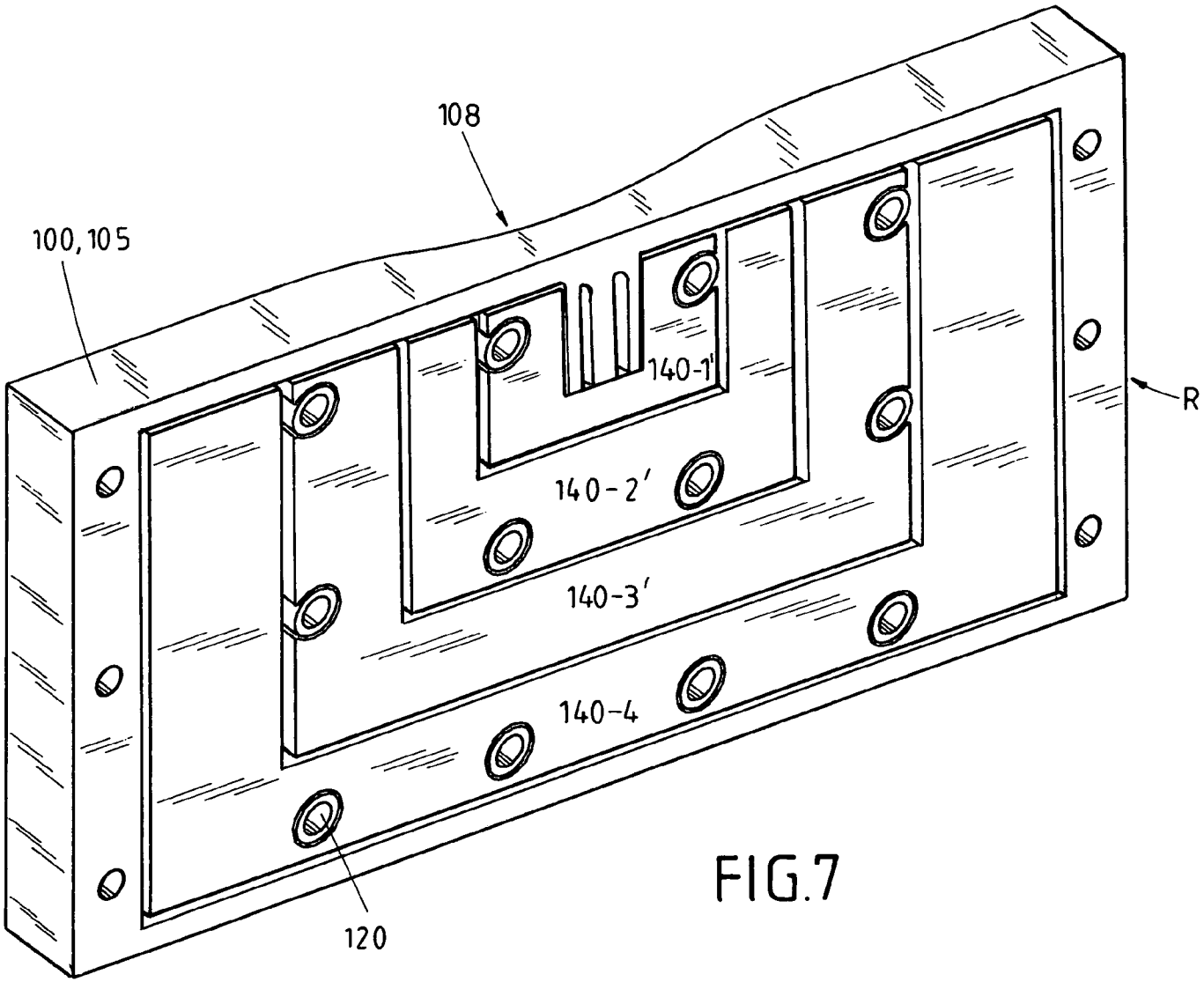
FIG. 7 shows the backside of the broadside according to the second embodiment with inserted filler elements.

FIGS. 6 and 7 illustrate a second embodiment according to the invention, wherein same technical characteristics are designated with the same reference numerals. The second embodiment differs from the first embodiment in the shape of the filler elements 140-1, 140-2, 140-3 which, according to the second embodiment, unlike in the first embodiment, are not rectangular, but of U-shaped configuration. Because of their modified embodiment, these filler elements in FIGS. 6 and 7 are respectively identified with an apostrophe in their reference numerals. Analogously, the recesses A1', A2' and A3' provided for these filler elements are now also of U-shaped configuration. The fourth filler element 140-4 was already in the first embodiment of U-shaped configuration, and insofar remains unchanged in the second embodiment.

FIG. 6 shows, analogous to FIG. 2, the backside R of the broadside with the recesses A1', A2', A3' and A4 as well as the corresponding filler elements 140-1', 140-2', 140-3' and 140-4 for filling the recesses according to the second embodiment of the invention.

FIG. 7 shows the backside R of the broadside with inserted filler elements according to the second embodiment.

While specific embodiments of the invention have been described in detail to illustrate the inventive principles, it will be understood that the invention may be embodied otherwise without departing from such principles.

The invention claimed is:

1. Broadside (100) of a funnel mold for the casting of metal, with:

groove-shaped cooling channels (110) in the backside (R) of the mold plate (100);

a plurality of recesses (A1, . . . , A5) in the backside; and a plurality of block-shaped filler elements (140-1, . . . , 140-5) for the at least partial sealing of the recess;

wherein the recess (A1, . . . , A5) is formed in such a manner, that each crosses a plurality of cooling channels (110) diagonally to their longitudinal direction; and that each recess is in its expansion in longitudinal direction of each cooling channel confined at least to a section of the cooling channel, and that, in this longitudinal direction, each recess has a rectangular-shaped and/or wedge-shaped cross-section, so that the cross-section of the cooling channels (110) in the broadside (100) in the area of the crossing recesses varies in a cascaded manner and is provided with the corresponding block-shaped filler elements (140-1, . . . , 140-5), whereby the cooling channels permit free flow between steps of the cascaded cross-section, wherein in the backside of the broadside (100), and distributed over the height of the broadside, are provided several recesses (A1, . . . , A5) of respectively varying depth, wherein the depths of the individual recesses increase with increasing distance from the upper rim (105) and from the mold center of the mold.

2. The broadside (100) according to claim 1, wherein the funnel opening is between 5 and 30 mm.

3. The broadside (100) according to claim 1, wherein the recesses (A2, . . . , A4) are configured symmetrically toward the center of the mold.

4. The broadside (100) according to claim 1, wherein the recess (A1, . . . , A5) and the corresponding filler element, in a top view of the backside (R) of the broadside (100), are rectangular shaped.

5. Broadside (100) according to claim 1, wherein the difference in depth between the two adjacent recesses (A1, A2) is between 0.5 and 4 mm.

6. Broadside (100) according to claim 1, wherein the multiple recesses (A1, . . . , A5) are arranged immediately adjacent each other and that they form an overall recess with a terraced-shaped bottom in the backside of the mold plate.

7. Broadside (100) according to claim 1, comprising at least one mounting bar (130) formed on the backside (R) of the broadside (100) and configured in one piece with the backside (R), for fastening of the broadside (100) with its backside to a water tank for the provision of cooling water for the cooling channel (110), wherein the mounting bar (130) remained after the formation of the groove-like cooling channel and the recess in the backside of the broadside (100).

8. Broadside (100) according to claim 7, wherein the mounting bar has a bore (120) and a screw thread.

9. Broadside (100) according to claim 1, wherein the filler element (140-1, . . . , -5) is in its outer diameter and in its thickness at least approximately complementary to the recess (A1, . . . , A5), so that it fills the volume defined by the recess.

10. Broadside (100) according to claim 1, wherein the filler element (140-1, . . . , -5) is configured as one-piece element, multi-piece element or in layers.

11. Broadside (100) according to claim 1, wherein the filler elements (140-1, . . . , -5) for covering several recesses (A1, . . . , A5) are connected with each other to form an overall filler element which represents the backside of the broadside (100) in a holohedral planar configuration.

12. Broadside (100) according to claim 1, wherein the filler element (140-1, . . . , -5) is configured as filler plate made of a heat-conductive material.

13. Broadside (100) according to claim 1, wherein the filler element (140-1, . . . , -5) is made of non-magnetic material.

14. Broadside (100) according to claim 1, wherein the recesses (A1, . . . , A5) are at least partially of U-shaped configuration.

15. Broadside (100) according to claim 1, wherein the geometry of the individual cooling channels (110) and thus the water speed for the adjustment of a desired temperature profile of the working side of the mold plate is designed differently.

16. Broadside according to claim 1, wherein the individual filler elements (140-1, . . . , -5) are connected by soft soldering or gluing.

17. The broadside (100) according to claim 1, wherein the recess (A1, . . . , A5) and the corresponding filler element, in a top view of the backside (R) of the broadside (100), are U-shaped.

18. The broadside (100) according to claim 5, wherein the difference in depth between the two adjacent recesses (A1, A2) is between 1 and 2 mm.

19. Broadside (100) according to claim 12, wherein the filler element (140-1, . . . , -5) is configured as filler plate made of copper or a copper alloy.

20. Broadside (100) according to claim 13, wherein the filler element (140-1, . . . , -5) is made of a plastics material.

* * * * *